United States Patent [19]

Dahlgren

[11] Patent Number: 4,898,007

[45] Date of Patent: Feb. 6, 1990

[54] MOISTURE MANAGEMENT SOCK

[76] Inventor: Ray E. Dahlgren, 56 Corto Rd., Arcadia, Calif. 91006

[21] Appl. No.: 121,156

[22] Filed: Nov. 16, 1987

[51] Int. Cl.[4] ..... A41B 11/02; D04B 9/46

[52] U.S. Cl. ..... 66/185; 2/239; 66/186; 66/187

[58] Field of Search ..... 66/178, 183, 184, 185, 66/187, 186, 202; 2/239

[56] References Cited

U.S. PATENT DOCUMENTS

| | | | |
|---|---|---|---|
| 2,144,563 | 1/1939 | Davis | 66/182 |
| 3,250,095 | 5/1966 | Bird | 66/178 |
| 3,303,379 | 3/1967 | Woolley et al. | 66/178 |
| 3,793,851 | 2/1974 | Thorneburg | 66/185 |
| 4,172,370 | 10/1979 | Safrit et al. | 66/182 |
| 4,194,249 | 3/1980 | Thorneburg | 2/239 |
| 4,195,497 | 4/1980 | Goldstein | 66/185 |
| 4,255,819 | 3/1981 | Klingspor | 2/239 |
| 4,255,949 | 3/1981 | Thorneburg | 66/185 |
| 4,263,793 | 4/1981 | Safrit et al. | 2/239 X |
| 4,277,959 | 7/1981 | Thorneburg | 66/185 X |
| 4,341,096 | 7/1982 | Safrit et al. | 66/182 |
| 4,373,361 | 2/1983 | Thorneburg | 66/178 R |
| 4,615,188 | 10/1984 | Hursh et al. | 66/196 |

FOREIGN PATENT DOCUMENTS

| | | | |
|---|---|---|---|
| 60-126357 | 7/1985 | Japan | 66/202 |
| 61-47854 | 3/1986 | Japan | 66/202 |

OTHER PUBLICATIONS

Wignall, H. "Hosiery Technology", United Outer Wear Assoc., 1968, N.Y., N.Y., pp. 63–64.

*Primary Examiner*—Ronald Feldbaum

*Attorney, Agent, or Firm*—Bell, Seltzer, Park & Gibson

[57] ABSTRACT

An improved sock wherein moisture distribution, wicking, evaporation and other phases of control, as well as stretch and cushioning, are all managed by the sock construction. The toe and heel portions are knit predominately, or entirely, of hydrophilic yarn while the instep portion extending therebetween is knit of hydrophobic yarn so that moisture absorbed from the wearer'foot by the hydrophilic yarn in the toe and heel portions is transferred by wicking action into the hydrophobic yarn in the instep portion to be evaporated therefrom.

8 Claims, 3 Drawing Sheets

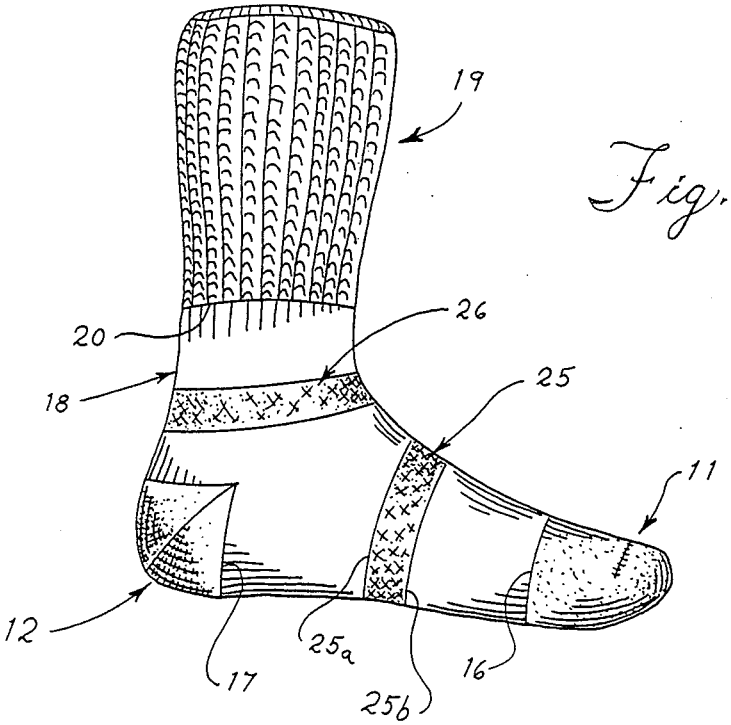
Fig. 3
Fig. 4
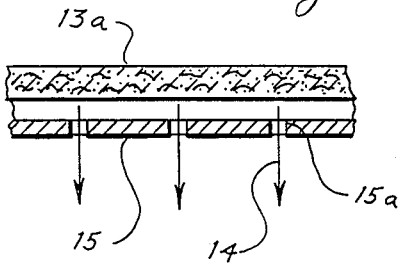
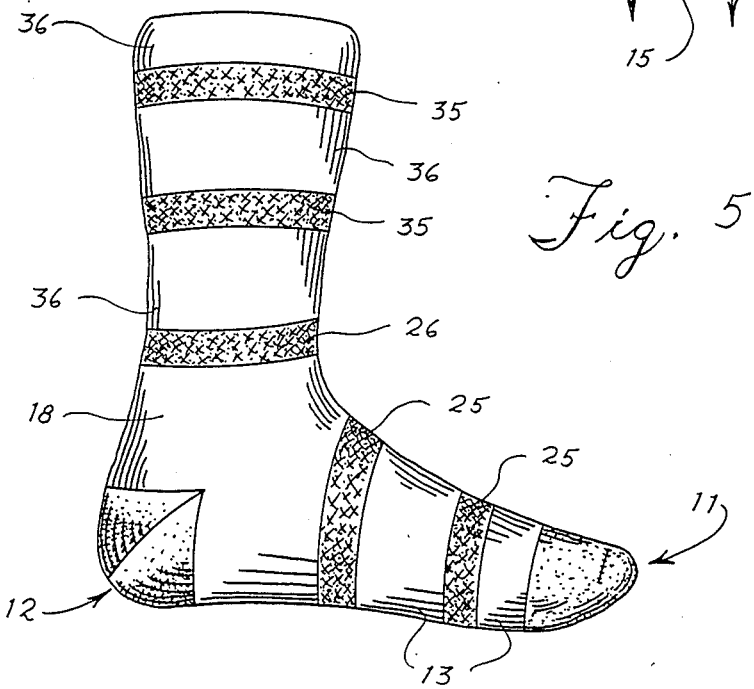
Fig. 5

MOISTURE MANAGEMENT SOCK

BACKGROUND OF THE INVENTION

This invention relates generally to athletic socks, and more particularly to an improved sock in which moisture distribution, wicking, evaporation and other phases of control, as well as stretch and cushioning, are all managed by the sock construction.

The moisture that occurs or develops in the foot area is necessary and healthful; however it is also uncomfortable, in excess. Currently it has been the practice to rely upon hydrophobic (i.e. non absorbent) yarn worn against the skin to remove moisture away from the skin. Hydrophobic yarns consisting of synthetic resinous material (petroleum based) are non-absorbent, and can result in an uncomfortably wet sock condition underfoot due to imbeded air flow and heat retentive characteristics of the yarn. There is need for an improved sock in which moisture collection and disposition are better managed.

SUMMARY OF THE INVENTION

It is a major object of the invention to provide an improved sock meeting the above need. The concept upon which the invention is based is the use of both hydrophilic and hydrophilic yarn in a sock, to first absorb or dry-off the skin, locally, using hydrophilic yarn, and thus to remove or transfer the moisture from the hydrophilic to hydrophobic yarn and to an area where evaporation can more readily take place. Accordingly, the sock of the invention has the following yarn zones:

(i) a first zone at the toe of the sock wherein the yarn is predominately hydrophilic, (ii) a second zone at the heel of the sock wherein the yarn is predominately hydrophilic, and (iii) a third zone at the instep between the first and second zones wherein the yarn is predominately hydrophobic.

As a result, moisture absorbed from the wearer's foot by the yarn at the first and second zones is transferred by wick action into the yarn at the third zone, for such ready removal, as by evaporation. As will be seen, the yarn at the first, second and third zones have lower sections engagable with the bottom of the wearer's foot, said yarn sections having the form of a cushioned terry knit. Also, the yarn at all three zones preferably includes synthetic resin binder yarn for form and fit and to serve as a backing for the terry knit; and the yarn at the first and second zones preferably includes hydrophilic yarns such as cotton in an amount between 50 and 100 percent of the total yarn at the first and second zones. The synthetic resin typically comprises Nylon. Considering that sweat glands of the foot are concentrated at the toe and heel area, the following qualities are taken into account and provided:

(1) Evaporation—Acrylic (such as Creslan or Orlon) is preferably employed as a component of the hydrophobic yarn or yarns, for evaporative, transference of moisture, fit, and good adherence.

(2) Absorption and Comfort—Wool or cotton is employed as the hydrophilic yarn due to its ability to absorb many times its weight in moisture; also, such yarns do not irritate the skin and are not clammy or sticky, and each is a "breathing" fabric that does not create or concentrate heat, and it can be easily sanitized. The acrylic or hydrophobic yarns are not used in predominance throughout the sock in order to obtain maximum moisture absorptive qualities and benefits of hydrophilic yarns without creating or concentrating heat, as in related moisture.

More specifically, a "framework" of Nylon, i.e. "binder yarn" is employed on the outside of the sock, leaving the terried hydrophilic yarn against the foot as at the heel and toe, providing fit, stretch memory, and a backing for the terry knit. Whereas Acrylic (synthetic fiber) is typically used in hydrophobic areas of the sock, it is not employed at the heel and toe in order to enhance the hydrophilic effect of the cotton or wool yarn at those areas. A cushioned terry knit may be employed along the entire bottom of the sock, from the toe to the heel, but the cushion is not used over the instep to allow for more effective evaporation of moisture absorbed by the hydrophilic yarn.

Additionally, other hydrophilic areas may be employed, as will appear.

These and other objects and advantages of the invention, as well as the details of an illustrative embodiment, will be more fully understood from the following specification and drawings, in which:

DRAWING DESCRIPTION

FIG. 3 is a side elevation showing a modified sock;

FIG. 4 is a fragmentary view;

FIG. 5 is a further modified sock; and

DETAILED DESCRIPTION

Figure 1:
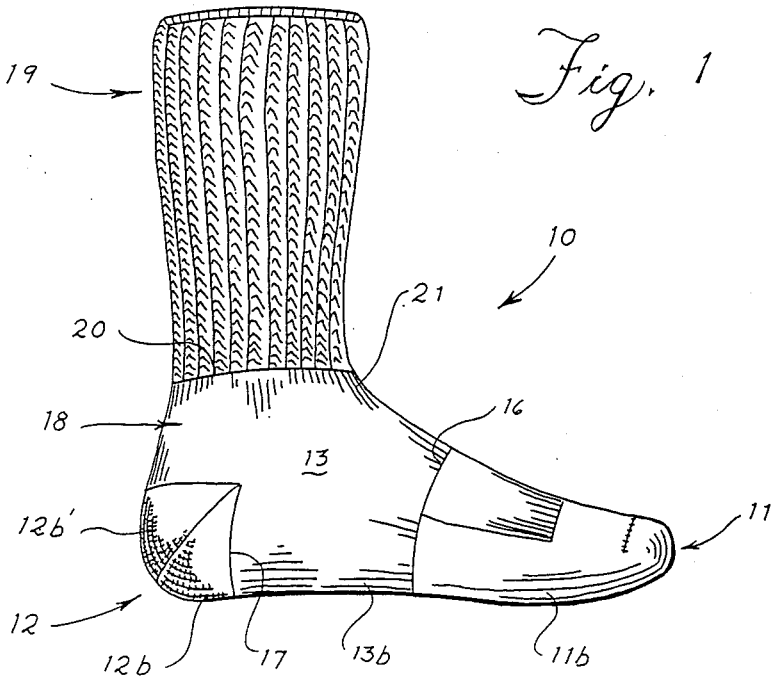
FIG. 1 is a side elevational view showing a sock embodying the invention.
Figure 2:
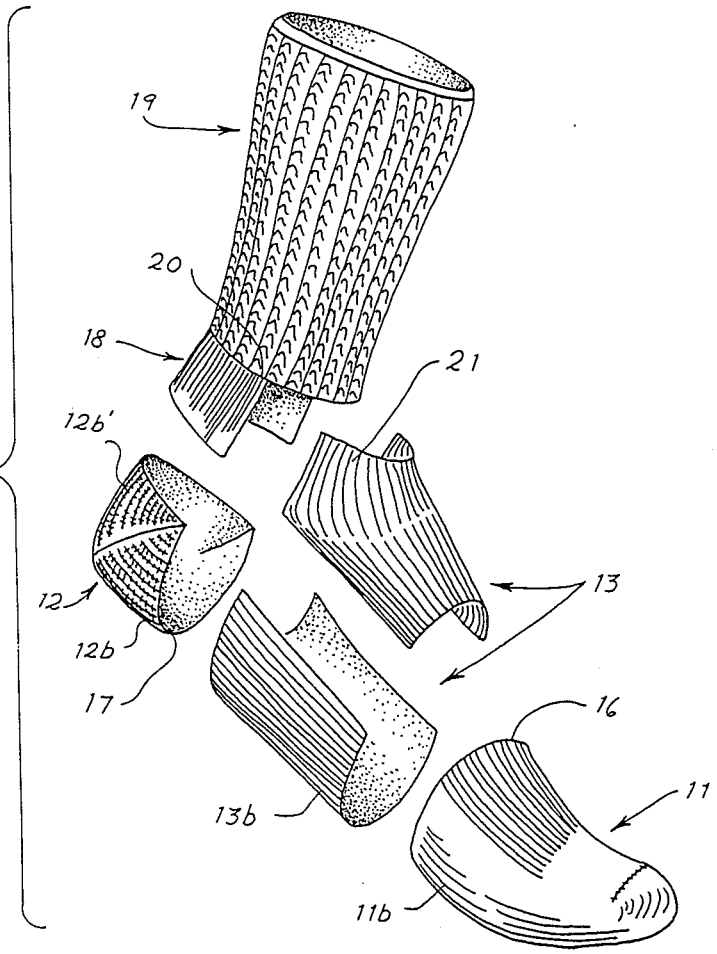
FIG. 2 is a perspective exploded view showing the structure of the FIG. 1 sock.

Referring first to FIGS. 1 and 2, a knit sock 10, in which foot moisture is managed by the sock knit construction, including three basic yarn zones:

(i) a cup-shaped first zone at the toe of the sock (see for example zone 11) wherein the yarn is predominately and relatively hydrophilic, i.e. characterized as tending to absorb moisture from the toe area of the wearer's foot, and particularly the underside of the wearer's toes which the sock supports and cushions, and to distribute moisture to the third zone to be described;

(ii) a smaller cup-shaped second zone 12 at the heel of the sock (see for example zone 12) wherein the yarn is predominately hydrophilic, i.e. characterized as tending to absorb moisture from the heel area of the wearer's foot, and particularly the underside of the wearer's heel which the sock supports and cushions, and also to distribute moisture to the third zone to be described;

(iii) a generally tubular third zone at instep (see for example zone 13) at and over the instep of the sock between zones 11 and 12, and to transfer such moisture received from heel and toe zones with normal action of the foot, to the exterior as by wicking and evaporation (and through vent holes in a surrounding shoe. See for example FIG. 4 showing a section **13*a* of zone 13, and moisture flow paths 14 from section 13*a* through vent holes 15*a* in shoe section 15**.)

As shown, zone 11 is contiguous and joined edgewise or coursewise to zone 13 at looping oval edge 16 extending about the sock forward of the instep; and zone 12 is contiguous and joined edgewise or a coursewise to zone 13 at U-shaped edge 17. Yarns at the zones 11–13 have lower sections 11*b*, 12*b*, and 13*b* engagable with the bottom of the wearer's foot, section 12*b'*. Sections 11*b*, 12*b* and 13*b* typically have the form of a cushioned or padded terry knit yarn, for extra comfort.

Figure 6:
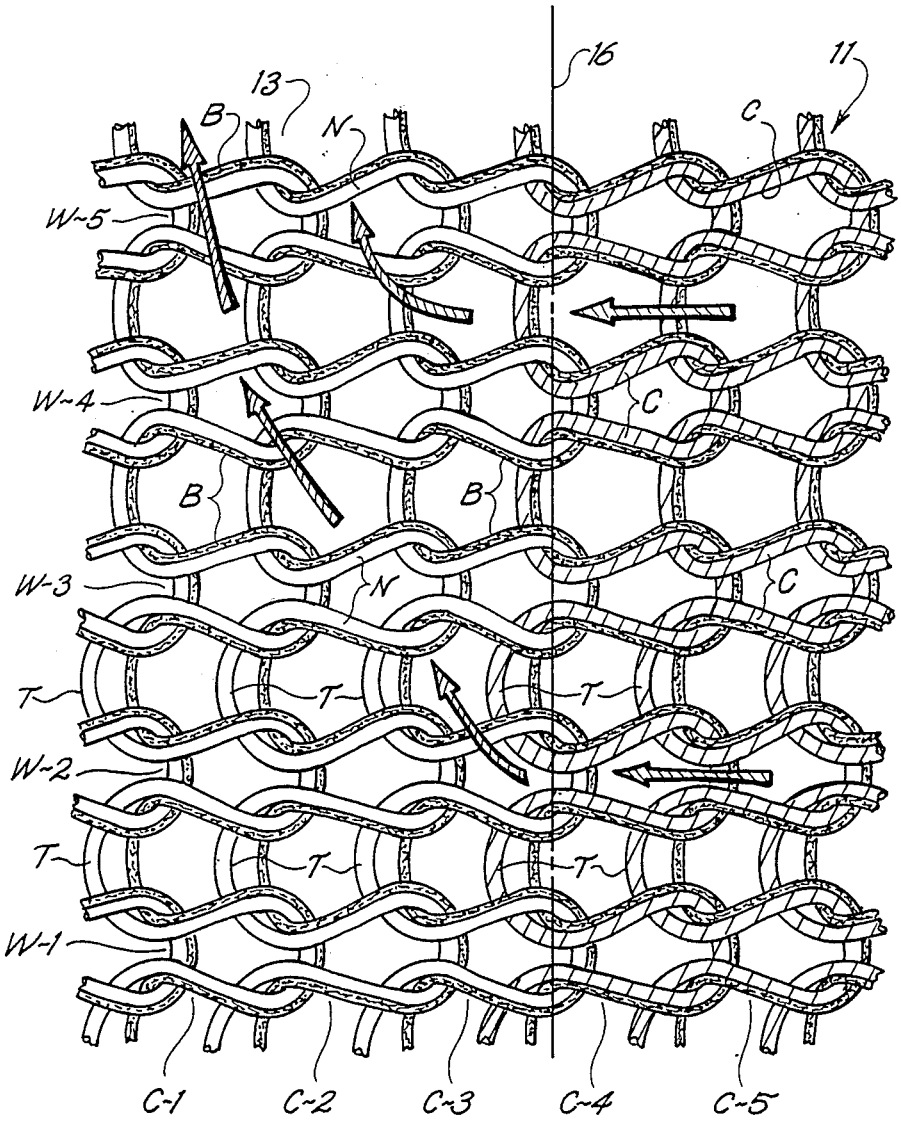
Figure 6 is a greatly enlarged view of the stitch loop construction in the area of the central portion of the line 16 in FIG. 1.

As shown in the portion of knit fabric of FIG. 6, needle wales W-3, W-4 and W-5 are located in the upper half of the foot and needle wales W-1 and W-2 are located in the lower half or sole of the foot. The portion of the knit fabric in courses C-1, C-2 and C-3 is located in the instep zone 13 and to the left of the edge 16 while the courses C-4 and C-5 are located in the ball portion of the toe zone 11. The entire foot is knit throughout of a hydrophobic binder or body yarn B while additional hydrophilic yarn C (striped in FIG. 6) is knit in plated relationship with the body yarn B in the first and second zones 11, 12 (toe and heel portions), and additional hydrophobic yarn N (plain in FIG. 6) is knit in plated relationship with the body yarn B in the third zone 13 (instep and sole portion). As shown, terry loops T are formed of the yarns C and N in the sinker wales between the needle wales W-1, W-2 and W-2, W-3.

In either athletic, leisure, or dress type socks, the hydrophobic body yarn B forms a base or ground fabric and is much smaller than the additional hydrophobic yarn N and the additional hydrophilic yarn C. For example, in an athletic type sock, it is preferred that the body yarn B be a textured stretch nylon of two ply, 100 denier (total of 200 denier), the additional hydrophobic yarn N be an acrylic, such as Creslan, of two ends, 24 single count (equivalent to 443 denier), and the additional hydrophilic yarn C be a 12 single count cotton yarn (equivalent to 443 denier). In this particular example, the amount of the hydrophobic body yarn B is substantially one-half the amount of the hydrophilic yarns C in the first and second zones 11, 12 and the hydrophobic yarn N in the third zone 13.

Thus, the first and second zones 11, 12 (toe and heel portions) are knit predominately of hydrophilic yarn while the third zone 13 (instep and sole portion) is knit entirely of hydrophobic yarn. Opposite ends of the third zone 13 are joined edgewise or coursewise to the adjacent ends of the corresponding first and second zones 11, 12 so that moisture absorbed from the wearer's foot by the predominately hydrophilic yarn C in the first and second zones 11, 12 (toe and heel portions) is transferred by wicking action into the predominately hydrophobic yarn N in the third zone 13 (instep portion) to be evaporated therefrom, as indicated by the arrows in FIG. 6, showing the path of travel of the moisture from the first zone (toe) 11 to the third zone (instep) 13. As shown in FIG. 1, the toe portion 11 also includes an adjacent portion of the foot of the sock which is adapted to engage and underlie the ball of the wearer's foot. This ball portion is also knit predominately of the hydrophilic yarn C.

While the hydrophobic body yarn B is knit throughout the sock, for the purpose of providing sufficient stretch to the sock to fit a range of foot sizes, it is to be understood that the sock can be knit without a body yarn. In this instance, the first zone (toe) 11 and the second zone (heel) 12 will be knit entirely of hydrophilic yarn C and the third zone (instep) 13 will be knit entirely of the hydrophobic yarn N. Thus, when the first zone (toe) 11 and the second zone (heel) 12 are described as being knit predominately of the hydrophilic yarn, this is intended to also mean that these zones can be knit entirely of the hydrophilic yarn as indicated in the TABLE below where the zones 11 and 12 are indicated as being knit of 100% hydrophilic yarn and the zones 13 and 18 are indicated as being knit of 100% Nylon or Creslan (hydrophobic) yarn.

The moisture management sock may also include:

(iv) a fourth yarn zone (see for example zone 18) which is generally tubular and extends about the foot at ankle level, above heel zone 12, and wherein the yarn is predominately hydrophobic, and typically merges with the yarn of instep zone 13 at region 21. The yarn of zone 18 tends to wick moisture upwardly away from the upper part of heel zone 12 and to transfer such moisture to the exterior as by evaporation just above show level, at the ankle region. FIGS. 1 and 2 also show a sock upper tubular and cushioned portion 19 to fit about the wearer's lower leg, and which also consists of hydrophobic yarn, merging with section 18, at edge 20.

The yarn at all three zones 11, 12 and 13, and also at zone 18, is knit in plated relationship with the synthetic resin binder or body yarn to enhance fit and to serve as a backing for terry knit; and the yarn at the first and second (hydrophilic) zones 11 and 12 typically includes cotton or wool in an amount between 50 and 100 percent of the total yarn at said zones 11 and 12. Typically, there is little or no cotton yarn at zones 13 and 18. The cotton yarn is knit with the synthetic resin binder or body yarn at zones 11 and 12, using conventional knitting machines and plating processes, and most desirably, the amount of hydrophilic yarn is about 75 percent of the total yarn at zones 11 and 12.

The synthetic resin binder or body yarn at all zones most desirably includes resiliently stretchable Nylon, or equivalent; and the synthetic resin yarn at zones 13 and 18 most desirably includes Acrylic yarn, or equivalent, in amounts substantially greater than the Nylon yarn at zones 13 and 18.

The following TABLE shows the yarn proportions:

| Zones | Yarn | Range (%) | Preferred (%) Athletic | Preferred (%) Dress |
|---|---|---|---|---|
| 11 & 12 | Hydrophilic | 50–100 | 75 | 100 |
| 13 | Nylon | 50–0 | 25 | 0 |
| | Creslan | 50–100 | 75 | 100 |
| 18 | Nylon | 50–0 | 25 | 0 |
| | Creslan | 50–100 | 90 | 100 |

In the above, the Nylon binder or body yarn is a resiliently stretchable, i.e. elastic, yarn, whereby the sock will stretch to closely fit a wide range of foot sizes. If the sock is not to be stretchable, Nylon binder or body yarn may be omitted, i.e. all synthetic yarn may consist of Creslan, or equivalent.

FIG. 3 shows a modified sock which is like the FIG. 1 and 2 sock, but includes either or both of the fifth and sixth zones 25 and 26, as shown. Fifth yarn zone 25 is spaced from and between the zones 11 and 12, and extends about the wearer's foot in a loop, with third zone yarn extending between zone 25 and zones 11 and 12, as shown. Note contiguity lines 25a and 25b. Zone 25 yarn is also predominately hydrophilic and has the same composition as yarn in zones 11 and 12 in the above TABLE. Sixth zone 26 is spaced above the wearer's ankle region. Fourth zone yarn material extends above and below zone 26, as shown. Zone 26 yarn is also predominately hydrophilic, and has the same composition as yarn in zones 11 and 12, in the above TABLE. Zones 25 and 26 enhance the moisture management effect, i.e. they collect moisture and transfer it to wicking zones 13 and 18, for better transfer to the exterior—i.e. away from the sock and foot.

FIG. 5 shows a further modified sock, typically for use in a boot on the wearer's foot. See alternating hydrophilic bands 35 and hydrophobic bands 36, in addition to the structure as described previously.

I claim:

1. An improved moisture management sock including a foot comprising a toe portion, a heel portion, and an instep portion positioned between said toe and heel portions, (a) said foot having the following yarn zones:

(i) a first zone comprising said toe portion, and wherein said first zone is knit predominately of hydrophilic yarn, (ii) a second zone comprising said heel portion, and wherein said second zone is knit predominately of hydrophilic yarn, and (iii) a third zone comprising said instep portion and being joined edgewise with said first and second zones, and wherein said third zone is knit predominately of hydrophobic yarn, and (b) whereby moisture absorbed from the wearer's foot by the hydrophilic yarn in said first and second zones (toe and heel portions) is transferred by wicking action into the hydrophobic yarn in said third zone (instep portion) to be evaporated therefrom.

2. A moisture management sock according to claim 1 wherein a hydrophobic body yarn is knit throughout said foot and in plated relationship with said hydrophilic yarns of said first and second zones and said hydrophobic yarn of said third zone, and wherein the amount of said hydrophobic body yarn is substantially one-half the amount of said hydrophilic yarns of said first and second zones and said hydrophobic yarn of said third zone.

3. A moisture management sock according to claim 2 wherein said first, second and third zones include lower sections engageable with the bottom of the wearer's foot, and including terry loops extending inwardly from said lower sections and adapted to engage the bottom of the wearer's foot.

4. A moisture management sock according to claim 1 and including (iv) a fourth zone extending above said second zone and adapted to engage the wearer's ankle, and wherein said fourth zone is knit predominately of hydrophobic yarn whereby moisture absorbed from the wearer's heel by the hydrophilic yarn in said second zone is transferred by wicking action into the hydrophobic yarn in said forth zone (ankle portion) to be evaporated therefrom.

5. A moisture management sock according to claim 1 wherein said first zone comprises said toe portion and an adjacent portion of said foot adapted to engage the ball of the wearer's foot, and wherein said adjacent portion of said foot (ball portion) is also knit predominately of hydrophilic yarn.

6. A moisture management sock according to claim 2 wherein said hydrophobic body yarn is stretch nylon, said hydrophilic yarn in said first and second zones is cotton, and said hydrophobic yarn in said third zone is acrylic.

7. A moisture management sock according to claim 1 including a leg portion comprising alternating bands knit predominately of hydrophilic yarn and bands knit predominately of hydrophobic yarn.

8. An improved moisture management sock including a foot comprising a toe portion, a heel portion, and a sole portion positioned between said toe and heel portions, (a) said foot having first, second and third yarn zones respectively associated with said toe, heel, and sole portions of the sock between said toe and heel portions, and said first, second and third yarn zones being knit throughout of a hydrophobic body yarn, (b) additional hydrophilic yarn being knit in plated relationship with said hydrophobic body yarn in said first and second zones, (c) additional hydrophobic yarn being knit in plated relationship with said hydrophobic body yarn in said third zone, (d) the additional hydrophilic yarns knit in said first and second zones being larger than the hydrophobic body yarn, (e) whereby moisture absorbed from the wearer's foot by the hydrophilic yarn in said first and second zones (toe and heel portions) is transferred by wicking action into the hydrophobic yarn in said third zone (sole portion) to be evaporated therefrom.

* * * * *

UNITED STATES PATENT AND TRADEMARK OFFICE

CERTIFICATE OF CORRECTION

PATENT NO. : 4,898,007

DATED : February 6, 1990

INVENTOR(S) : Ray E. Dahlgren

It is certified that error appears in the above-identified patent and that said Letters Patent is hereby corrected as shown below:

In the Abstract, lines 7-8, "wearer'" should be -- wearer's --.

Column 1, line 27, "hydrophilic" (second occurrence) should be -- hydrophobic --.

Column 1, line 29, "remove" should be -- move --.

Column 1, line 49, following "binder" insert -- or body --.

Column 3, line 4, delete "a".

Column 4, line 18, "show" should be -- shoe --.

Signed and Sealed this

Eleventh Day of December, 1990

*Attest:*

HARRY F. MANBECK, JR.

*Attesting Officer*

*Commissioner of Patents and Trademarks*